United States Patent [19]

Kosa

[11] Patent Number: 4,762,259

[45] Date of Patent: Aug. 9, 1988

[54] ROLLED SHEET MATERIAL DISPENSING DEVICE

[76] Inventor: Edward Kosa, 107 S. Mary Ave., No. 85, Sunnyvale, Calif. 94086

[21] Appl. No.: 924,418

[22] Filed: Oct. 29, 1986

[51] Int. Cl.[4] ..... A47K 10/36; B26D 1/03; B65D 85/672

[52] U.S. Cl. ..... 225/37; 225/25; 225/89; 225/90; 225/91; 242/55.3

[58] Field of Search ..... 225/37, 38, 34, 47, 225/25, 90, 89, 91; 242/55.3

[56] References Cited

U.S. PATENT DOCUMENTS 2,726,825 12/1955 Ziskin et al. ..... 242/55.3

3,132,784 5/1964 Cohen et al. ..... 225/37

*Primary Examiner*—Frank T. Yost

*Attorney, Agent, or Firm*—John J. Leavitt

[57] ABSTRACT

Presented is a device for supporting and facilitating the dispensing of sheet material contained on rolls. The device is provided with three separate center-forming roll support structures on each of which may be separately supported a roll of sheet material to be dispensed. Each of the roll support structures is spring pressed to impose an axial force on the roll to thus retain it engaged with the roll support. Additionally, each of the roll support structures is manipulable to enable an increase of the space within which a roll is to be supported to thus facilitate placement and removal of a roll of material or removal of an empty roll. Two of the roll support structures are also provided with lock devices to enable locking the roll support structures in a roll released condition, and these two roll support structures are associated with cutter bars adapted on the one hand to facilitate cutting of the material from the associated roll when the material is drawn against the cutting bar, and on the other hand adapted to retain the cut end of the material so that it is in position to be grasped to effect another tear. The device is collapsible to facilitate packing and shipping in minimal space, and may be attached to a wall or the underside of a cupboard or other support.

12 Claims, 3 Drawing Sheets

ROLLED SHEET MATERIAL DISPENSING DEVICE

BACKGROUND OF THE INVENTION

1. Field of the invention

This invention relates to rolled sheet material dispensing devices, and particularly to such a device that is collapsible for shipment in minimal space, employs roll center forming means that are retractible to facilitate placement and removal of roll material, and possesses a capacity for holding three rolls of rolled sheet material.

2. Description of the prior art

The prior art relating to this invention is believed to be located in Class 225, sub-classes 34 and 38; and Class 242, sub-classes 55.3 and 55.53. A preliminary patentability search through these classes and sub-classes has revealed the existence of the following United States patents:

| | | |
|---|---|---|
| 2,056,572 | 2,482,714 | 2,657,873 |
| 2,722,387 | 2,819,851 | 2,824,774 |
| 2,858,086 | 2,943,777 | 2,948,451 |
| 2,969,169 | 3,156,392 | 3,281,032 |
| 3,317,099 | | 3,603,519 |

Because of the convenience provided homemakers, the number and types of sheet material packaged in roll form has proliferated. For instance, metal foil, wax paper, hand towels, and plastic film are all packaged on rolls, the rolls usually formed from spirally formed paper cores. Unless some type of device is provided for supporting the rolls of sheet material in a convenient location for ready access by the homemaker, the rolls of sheet material must be stored in a pantry or in a drawer or cupboard where they are not readily accessible, or if accessible, not readily recognized as to the type of material contained in the roll for any of a number of reasons, not the least of which is the absence of light in the pantry, or interference by other boxes of rolls of sheet material. Accordingly, one of the objects of the present invention is the provision of a rolled sheet material dispensing device that has the capacity to hold at least three rolls of rolled sheet material.

In rolled sheet material dispensers of the type included in the patents listed above, one of the problems has been the difficulty with which a roll of material is mounted to replace an empty roll, especially when multiple rolls of sheet material are supported on the device. Accordingly, another object of the invention is the provision of a rolled sheet material dispensing device in which means are provided facilitating the replacement of an empty roll with a full roll in that the full roll does not form an obstruction to this procedure.

Because devices of this type are usually manufactured in one location, either domestically or in a foreign country, it is important that the device be collapsible to minimize the space required for shipping. Accordingly, another object of the invention is the provision of a rolled sheet material dispensing device constructed in such a manner that the supporting members may be collapsed to minimize the thickness of the unit.

In devices of this type, the sheet material is fed from a roll over a cutter bar in such a manner that tension on the sheet material with simultaneous drawing of the sheet material against the cutting edge of the cutting bar effects cutting of the sheet material. Unless the cutting bar is adjustable in its position, it is difficult to reach the roll support structures to enable placement or removal of a roll of sheet material. Accordingly, still another object of the invention is the provision of a rolled sheet material dispensing device equipped with at least one cutter bar that is adjustable in its position to facilitate access to the roll support structures.

Most rolled sheet material holders, particularly those designed particularly for supporting paper towel material, these being provided with perforations formed directly in the paper material and not requiring a cutting bar, do require that the end support plates that support the roll of paper towels be capable of being spread temporarily to admit the placement of a new roll of paper towels on the support plates. If one or more cutting bars for the other rolls of sheet material are also supported on the support plates, provision must be made for removal of such cutter bar or bars prior to spreading the support plates lest the bars interfere with such spreading action, or the bar or bars must be mounted in such a way that while they remain attached to the support plates, they nevertheless permit spreading of the support plates while simultaneously retaining the cutting bars attached thereto. Accordingly, a still further object of the invention is the provision of a roll sheet material dispensing device equipped with paper towel support plates and cutter bar or bars that accommodate relative movement between the support plates and the cutter bar.

The conventional means for supporting the smaller diameter rolled sheet material is to provide a circular boss over which the end of the hollow and cylindrical or tubular core of the roll is positioned in an embracing attitude. These bosses are usually in spaced alignment to support opposite ends of the roll, and are supported on support plates that may be spread apart sufficiently to permit interjection of the roll between the spaced apart and spread support plates which, when permitted to return to their normal position, close in on the ends of the roll so that the bosses project into the ends of the roll. The problem presented with this type construction, particularly where multiple rolls are so supported, is that in spreading the support plates, it is possible and usually probable that a roll not intended to be disturbed is released, thus requiring that two rolls be manipulated simultaneously to achieve engagement with the support plate bosses. Accordingly, a still further object of the invention is the provision of a rolled sheet material dispensing device equipped with retractable bosses that may be individually manipulated to load a roll of sheet material into the device.

A still further object is the provision of retractable bosses of the type described above which may be locked in retracted position.

In those conventional rolled sheet material dispensing devices that utilize cutting bars, no provision is made for retaining the severed end of the strip sheet material still attached to the roll from falling away from the cutting bar, thus increasing the difficulty of grasping the end of the sheet material to sever another length of the material. Accordingly, yet another provision of the invention is the provision of holding means associated with each cutting bar to grasp and retain the severed end of the sheet material still attached to the main body of material on the roll.

The invention possesses other objects and features of advantage, some of which, with the foregoing will be apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, the rolled sheet material dispensing device of the invention comprises a main body portion adapted to be removably attached to a supporting structure such as a wall or the underside of a convenient cupboard or cabinet. Mounted on the main body portion are support plates each provided with roll-supporting means, preferably three in number, arranged in axially aligned pairs to support individual rolls of rolled sheet material. The support plates are pivoted on the main body portion so that they may be folded down on the main body portion for shipping purposes. A plurality of separate cutter bars are provided supported in cooperative relation to the rolls of sheet material so that a length of the material may be drawn over the cutter bar to effect severing of the sheet material. At least one of the cutter bars is detachably mounted on the support plates and bridges the space therebetween in a manner to permit temporary and resilient spreading of the support plates without detachment of the cutter bar while permitting relative movement between the cutter bar and the support plates. At least two pairs of retractable bosses are provided on the support plates adapted to be engaged by opposite ends of the cores of rolls containing sheet material. Means associated with the retractable bosses enable locking of the bosses in retracted position. In addition to a cutting edge, usually a serrated edge, each of the cutting bars is also provided with means for grasping the end portion of the strip of sheet material still attached to the main body of the roll when a length of the strip is severed.

DESCRIPTION OF THE PREFERRED EMBODIMENT

Figure 1:
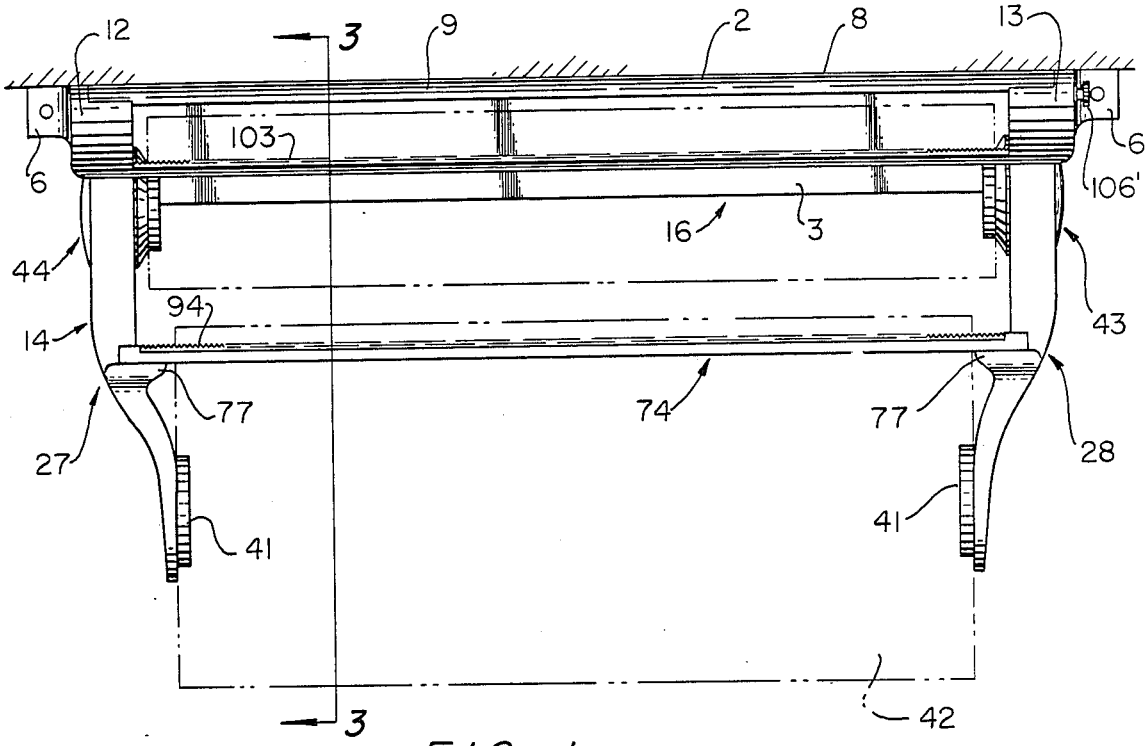
FIG. 1 is a front elevational view of my rolled sheet material dispensing device shown in the attitude it would be seen when mounted on a vertical wall or on the underside of a horizontal surface such as a cupboard.

In terms of greater detail, the rolled sheet material dispensing device of the invention comprises a holder and dispenser that is capable of receiving, holding and permitting the dispensing of material from three rolls of sheet material mounted on the device. The dispenser is constructed in such a way that it may be mounted beneath a cupboard or shelf, thus enabling easy access to the rolled sheet materials supported thereon, or it may be mounted on a vertical wall, or a vertical door of a cupboard or pantry.

It has come to pass in the United States that many different types of rolled sheet material are used for many different purposes within the home. Thus, highly transparent and strong plastic wrap is now used to wrap sandwiches, cover bowls containing food for storage in the refrigerator, and for insulating aluminum foil from acidic types of foods, where aluminum foil is used to cover such food items. Additionally, such aluminum foil is also packaged in rolls, to be torn off in selected lengths to use wherever indicated. Also, waxed paper, while losing some of its popularity to the transparent plastic films, is still used extensively and is also packaged in rolls from which lengths are torn for use. Paper towels are also packaged in rolls, and for the sake of cleanliness, should be supported on some type of roll support structure while selected lengths are dispensed therefrom to avoid contaminating the towel sections that remain on the roll.

The problem created by all the various types of materials that are packaged in roll form is one of ready and convenient availability when it is necessary to use a length of one of such materials. As indicated above, the usual practice is to store such rolls of rolled sheet material in a drawer, or on a shelf in a closet or pantry or cupboard. But when so stored, since each roll is enclosed within its own container, and there are of course multiple containers, a selection must first be made of the proper container, the container must then be removed from the drawer or storage compartment, and the container held with one hand while the proper length of material is torn off with the remaining hand. It thus becomes a two-handed operation. One of the objects of the present invention is that the operation of tearing off a length of rolled sheet material be reduced to a one-handed operation.

To that end, and referring now to the drawings, it will be seen that the rolled sheet material dispensing device is fabricated almost entirely from plastic and may thus be easily cleaned. Additionally, fabricating the device from plastic enables the use of well-known production techniques for mass production of the device, to thus minimize the cost to the consumer. Structurally, the device is comprised of a broad generally rectangular base member designated generally by the numeral 2, and having a depending apron wall 3 integral therewith along its rear edge 4, with integral apertured mounting lugs 6 extending from opposite corners of the base adjacent the apron wall to provide means by which the device may be mounted on a vertical wall. Additionally, four apertures 7 are provided in the base adjacent the corners thereof to facilitate mounting of the device to the underside of a shelf or cupboard, it being noted that the top surface 8 of the base 2 is unobstructed by any projections, thus permitting the base to snugly abut the surface of the shelf or cupboard to which it is attached.

Figure 14:
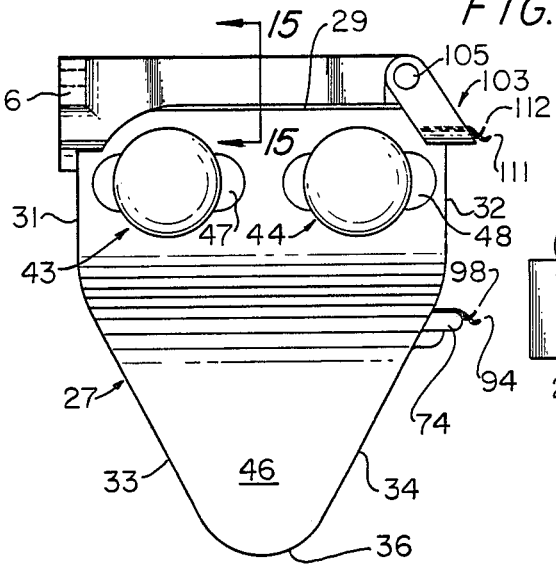
FIG. 14 is an end elevational view of the dispenser device taken in the direction of the arrow 14 in FIG. 1.
Figure 17:
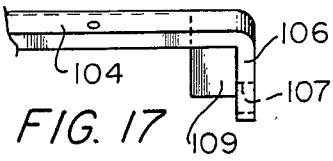
FIG. 17 is a fragmentary elevational view of a portion of the upper cutter bar apart from the remaining structure.
Figure 18:
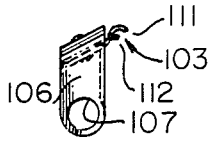
FIG. 18 is a fragmentary end view of the cutter bar shown in FIG. 17.
Figure 15:
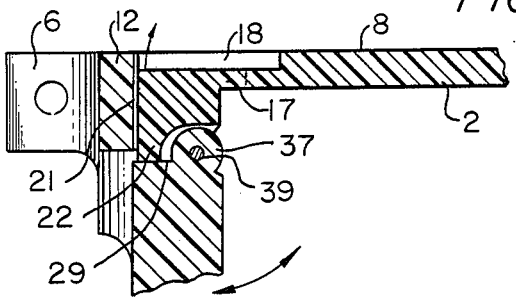
FIG. 15 is a fragmentary sectional view taken in the plane indicated by the line 15—15 in FIG. 14, and showing the pivotal connection of the roll support member on the base member.

The base member 2 also includes a front edge 9, and end edges 12 and 13 constituting short depending integral flanges that project downwardly below the plane of the body portion of the base member, as illustrated in FIGS. 14 and 15. Spaced along a medianly positioned longitudinal axis of the base member are a pair of apertures 14 and 16 for a purpose which will hereinafter be explained. Additionally, at each opposite end of the base member 2 adjacent the end edge flanges 12 and 13, the base is formed with an integral tongue 17, preferably produced by reducing the thickness of the base member 2 in the area 18 as shown in FIG. 15, and by forming slots 19 between the lateral ends of the tongue and the remainder of the base. The end of the tongue is spaced from the associated flange (12 or 13) by a space 21, and the end of each tongue is also provided with a depending flange which functions as a stop in a manner to be explained hereinafter.

Formed on the depending edges of end edge flanges 12 and 13 adjacent the front and rear edges thereof, i.e., spaced between the slots 19 and the associated front and rear ends of the flanges, are integral elongated bearing members 23 and 24, each provided with an elongated bore 26 adapted to form a pivotal bearing as will hereinafter be explained.

Pivotally suspended from the base member 2, and more specifically from the bearing members 23 and 24 at each opposite end of the base member are rolled sheet material support plates or members designated generally by the numerals 27 and 28. Since these support plates or members are mirror images of each other, in the interest of brevity, only one will be described in detail, it being understood that the other is similar in its construction. Accordingly, the same reference numbers are applied to corresponding parts of the support plates.

Figure 2:
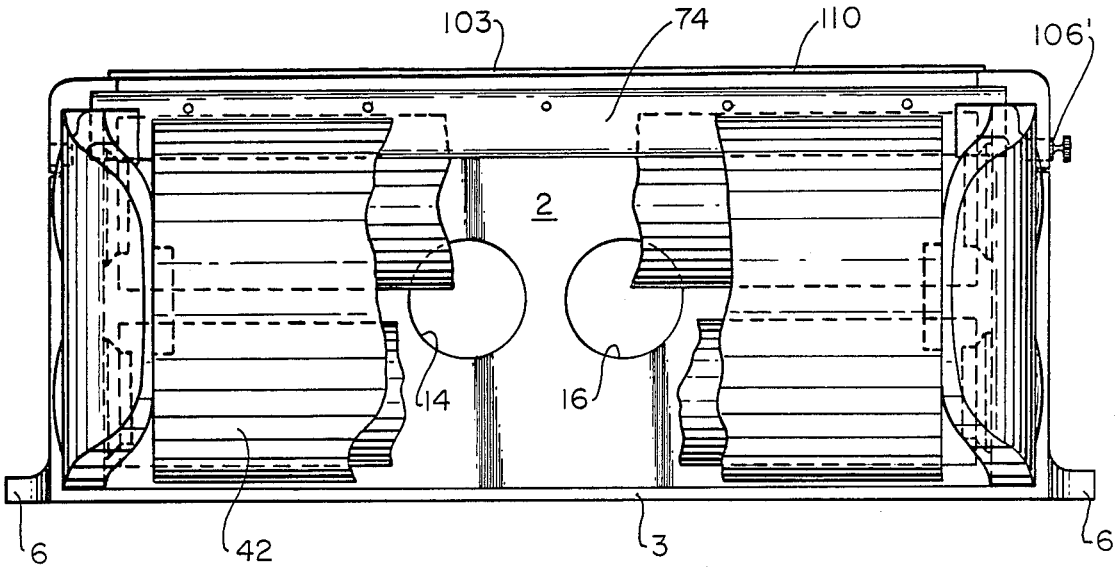
FIG. 2 is a bottom plan view of the rolled sheet material holder shown in FIG. 1.
Figure 3:
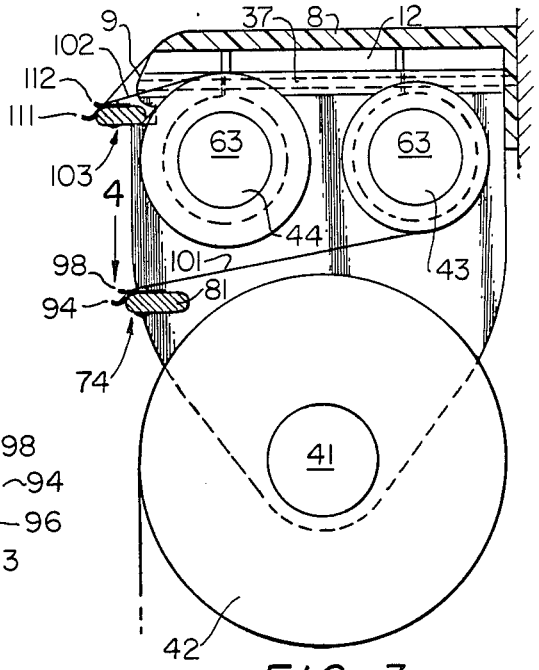
FIG. 3 is a vertical cross-sectional view taken in the plane indicated by the line 3—3 in FIG. 1.

As illustrated in FIGS. 3, 7-9, and 14, each of the support plates is preferably appropriately molded from a suitable plastic material, conveniently the same material as the base member 2, and includes a top edge 29 intercepted by parallel side edges 31 and 32 that depend downwardly to merge smoothly into converging edges 33 and 34, respectively, which join in a rounded end portion 36 as shown. The top edge of each support plate is provided with an elongated bearing member 37 (FIGS. 7-9 and 14) which projects from the top edge 29, the bearing member having an elongated bore 38 therethrough, the length of the bearing member being such that it fits snugly between the bearing members 23 and 24 formed on the end flanges 12 and 13 of the base member 2. In this position of the bearing member, the bore 38 thereof is aligned with the bores 26 in the bearing members 23 and 24, and each support plate is thus pivotally secured to the base member 2 by insertion of an elongated pin 39 through the aligned bores 26 and 38. In this relationship, the top edge 29 of the support plate rests on the bottom edge of the flange 22 of the tongue, whereby pressure exerted outwardly on the support plates imposes a stress on the flange, causing the tongue to bend resiliently upwardly a small amount, sufficient so that the inherent resilience of the tongues will cause the two spaced support plates to be biased in a direction tending to reduce the distance between them as viewed in FIG. 13. This inwardly directed biasing force is thus used to retain removably attached to the bosses 41 on the lower end portions of the support plates a roll 42 of rolled sheet material such as paper toweling, as seen in FIGS. 1 2 and 3. To engage the roll 42 of paper toweling on the bosses 41, all that is required is that the support plates be sprung outwardly sufficiently for the bosses 41 to clear the ends of the core of the roll of towels, the support plates then being permitted to move toward each other so that the bosses 41 engage the roll core.

Figure 7:
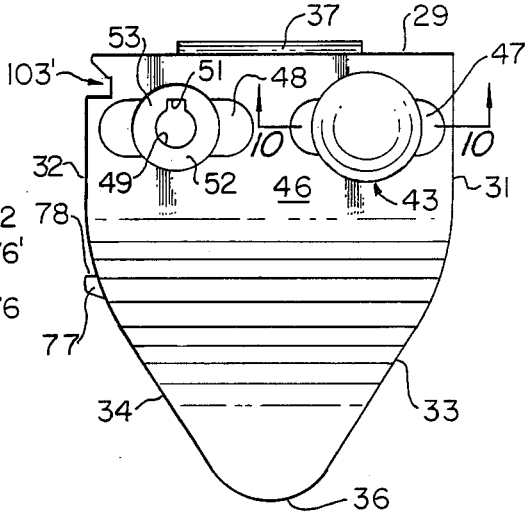
FIG. 7 is an end elevational view of one of the roll support members apart from the remainder of the base structure.
Figure 10:
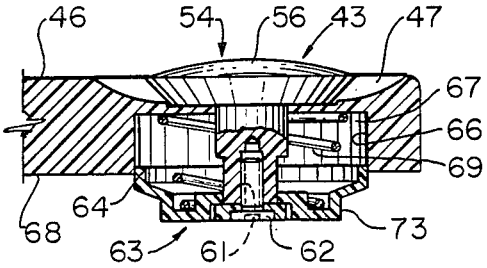
FIG. 10 is a horizontal cross-sectional view taken in the plane indicated by the line 10—10 in FIG. 7 and illustrating the construction of one of the retractable center-forming roll support bosses mounted on the roll support member.
Figure 11:
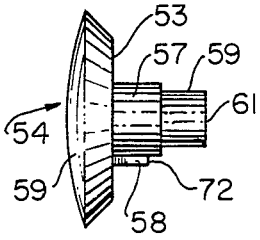
FIG. 11 is a side elevational view of one of the gripping heads associated with the retractable roll support bosses, but shown apart from the remaining structure.
Figure 12:
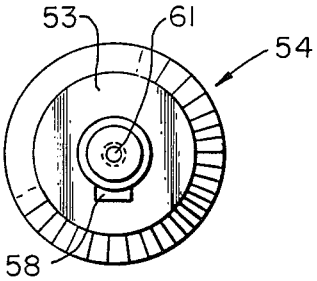
FIG. 12 is an end elevational view of the gripping head illustrated in FIG. 11.
Figure 16:
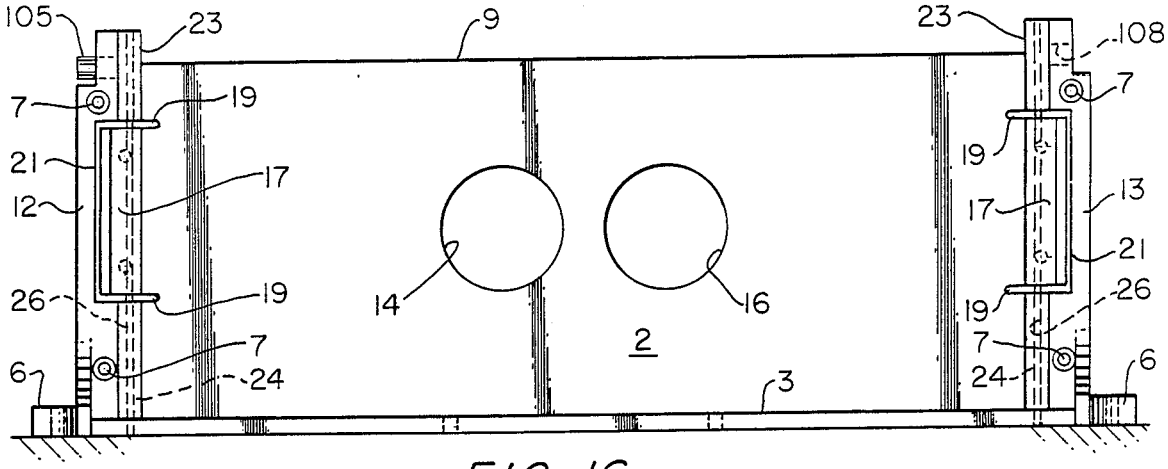
FIG. 16 is a bottom plan view of the base member of the dispenser device taken in the direction of the arrow 16 in FIG. 1, shown with the roll support members removed.

To rotatably support two additional rolls of rolled sheet material on the support plates 27-28, each of the support plates adjacent its upper edge is provided with a pair of roll support assemblies designated generally by the numerals 43 and 44. As seen in FIGS. 7, 10 and 14, the outer surface 46 of each of the support plates is provided with a pair of aligned yet spaced grooves 47 and 48 associated, respectively, with the support assemblies 43 and 44. As illustrated, each of the grooves is symmetrical with respect to a horizontal plane that is common to both grooves, and midway between the ends of each groove, the support plate is provided with a horizontal bore 49 having a key slot 51 formed therein. As seen in FIG. 7, concentric with each bore 49, the outer surface of the support plate is provided with a recess 52 that snugly receives the base end portion 53 of knob 54, the head 56 of which is convex as illustrated. The knob 54 is provided with a shank portion 57 sized to be rotatably journaled in the bore 49, the shank portion 57 having a predetermined length longer than an integral key 58 thereon adapted to engage the key slot 51 in bore 49. Thus, for reasons which will appear, the knob may be selectively positioned in the bore 49 so that it will not rotate when the the key 58 is engaged with the key slot 51, or it may be withdrawn axially from the bore 49 sufficiently to clear the key from the key slot while the shank portion 57 still engages the bore 49, thus permitting it to be rotated therein.

Axially aligned with the shank portion 57 on the end thereof opposite the head 56, is a shank extension 59, reduced in diameter from the diameter of the shank portion 57, but having a substantially equal length as shown. The shank extension 59 is provided with a threaded central bore 61 adapted to threadably receive the cap screw 62, which retains removably secured to the shank extension 59 the end cap 63 having a peripheral flange 64 adapted to slidably engage the inner peripheral and correspondingly configured surface 66 of a recess 67 formed in the inner surface 68 of the support plate, shown in FIGS. 9 and 10. Within the recess 67 there is positioned a coil spring 69 which at one end abuts the bottom surface 71 of the recess 67, which in fact constitutes an integral web of the support plate, while at its other end the coil spring impinges resiliently against the end cap 63 as shown in FIG. 10.

It will thus be seen that all that is required to mount a roll of rolled sheet material, such as wax paper or foil, on the roll support assemblies of the spaced support plates, is to insert the ends of the thumb and one finger in a groove 47 or 48 and grasp the knob 54, pulling gently thereon until the key 58 clears the key slot 51. In so doing, the coil spring 69 is compressed, the peripheral flange 64 more fully engages the inner peripheral surface 66, thus lending support to the assembly in cooperation with the portion of the cylindrical shank portion 57 that still engages the bore 49. When the key 58 clears the key slot 51, the knob is rotated a small amount to bring the end 72 of the key into abutting contact with the bottom surface 53 of the recess 52. The knob may then be released and it will be retained in retracted position while the roll of sheet material is positioned in alignment with the end cap 63 which, in addition to functioning as a support element for the support assembly, also functions to provide a cylindrical shoulder 73 adapted to engage the inner periphery of the roll core on which the rolled sheet material is wound. With the roll properly positioned, the knob is again grasped by one finger and the thumb and rotated to again align the key 58 with the key slot 51, at which point the knob is released to permit the spring 69 to bias the support assembly inwardly to engage the roll core.

It will be seen that in the placement of the rolls of rolled sheet material on the upper roll support assemblies 43 and 44 it is not necessary that the support plates 27 and 28 be resiliently separated as is done to mount a roll of paper toweling on the bosses 41. It is important, however, to note that even when the support plates 27 and 28 are resiliently spread to mount the roll of paper toweling, that action does not disengage the smaller diameter rolls of rolled sheet material mounted on the upper roll support assemblies 43 and 44. One reason for this is that the roll support assemblies 43 and 44 are mounted close to the pivot axis of the support plates, thus limiting the lateral motion of the roll support assemblies. In addition, by virtue of the resilient pressure exerted by the end caps 63 on the ends of the roll core through the function of the spring 69, the core and support assemblies are maintained in engagement until the knobs are retracted to compress the springs 69. A third reason is that the support plates 27 and 28 are limited in the amount they can be spread outwardly during the mounting operation of a roll of paper toweling. The means by which such outward movement is limited will now be described in detail, referring to FIGS. 1, 3, 4, 6, 8 and 9, where it is seen that the support plates 27 and 28 are spanned and releasably engaged approximately midway between their top edges 29 and their bottom end portions 36 by a cutter bar designated generally by the numeral 74.

To support the cutter bar 74, each support plate is provided approximately at the junction of the side edges 32 and 34, and on the inner surface 68 thereof, with a laterally extending recess 76 formed in association with a shoulder 77 projecting forwardly and inwardly from the inner surface of the support plate. The top surface 78 of the shoulder is provided with an upwardly extending boss 79 carried integrally on the part of the shoulder that projects inwardly beyond the inner surface 68 of the support plate. It should also be noted that each support plate is formed with a gentle offset or transitional portion that occurs generally where the side edges 31 and 32 merge smoothly with the converging edges 33 and 34. The result of this gentle offset or curved transition is to place the bosses 41 that support the roll of paper toweling closer to each other, or stated another way, not so far apart, as the support assemblies 43 and 44 which support the smaller diameter rolls of rolled sheet material, which are approximately one inch longer than the roll of paper toweling.

Figure 4:
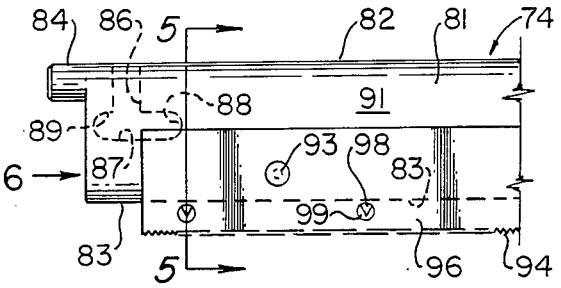
FIG. 4 is an enlarged fragmentary plan view of the top side of one of the cutter bars mounted on the roll support members, the view being taken in the direction of the arrow 4 in FIG. 3.
Figure 5:
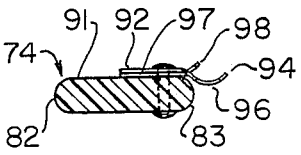
FIG. 5 is a vertical cross-sectional view taken in the plane indicated by the line 5—5 in FIG. 4.
Figure 6:
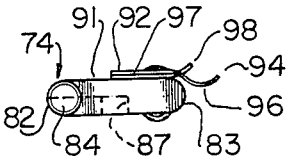
FIG. 6 is an end elevational view of the cutter bar shown in FIG. 4, taken in the direction of the arrow 6 in FIG. 4.
Figure 9:
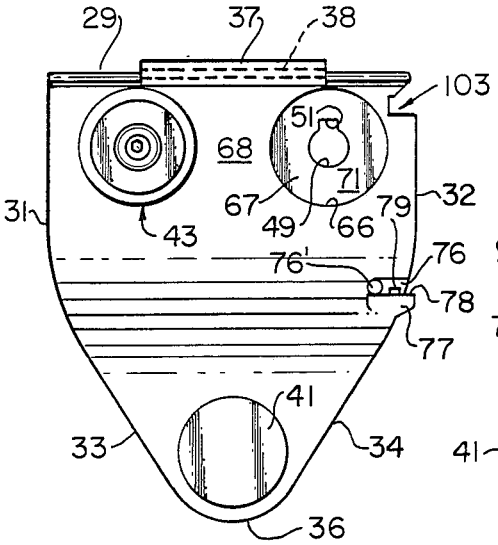
FIG. 9 is an elevational view of the support member of FIG. 8 taken in the direction of the arrow 9 in FIG. 8.
Figure 8:
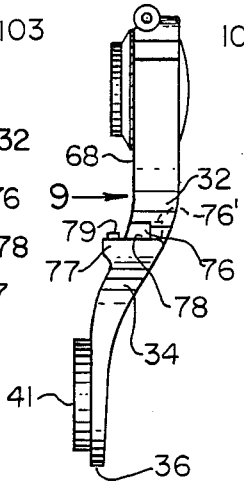
FIG. 8 is an edge view of the support member shown in FIG. 7.

The cutter bar 74 includes a base or body portion 81, elongated and generally rectangular in cross-section, with the long edges 82 and 83 rounded smoothly as shown in FIGS. 5 and 6. At opposite ends, associated with the edge 82, the bar is provided with projecting cylindrical bosses 84 adapted to engage and pass through the recesses 76 in the opposed support plates 27 and 28. The proportions of the bosses 84 and the bosses 79, and the spacing of the bosses 79 from the recesses 76 in the support plates permit the bosses 84 to slip betweem the bosses 79 and the bottom of recess 76 when the bosses 84 pass through the recesses 76. When the cutter bar is so engaged, the bosses 79 lie engaged in T-shaped slots formed adjacent each end of the cutter bar 74 as shown in FIG. 4, while each boss 84 lies caught in a complimentary bore 76' formed in the bottom of the recess 76. Each T-shaped slot is provided with a transversally extending portion 86 and a longitudinally extending portion 87, both at the same depth.

When the cutter bar 74 is applied to the support plates, the transverse slot portions 86 are brought into registry with the bosses 79 and the cutter bar is moved rearwardly until the bosses 79 engage the slot portions 87. To accomplish this, it is necessary to resiliently spread the support plates a small amount so that when the bosses 79 are engaged in the slot portions 86 the support plates are biased inwardly toward each other. When the bosses 79 engage the slot portions 87, this biasing force causes the bosses 79 to move longitudinally inwardly against the innermost ends 88 of the slot portion 87, thus limiting the inward movement of the support plates. When the roll of toweling material is mounted, it will of course be understood that from this innermost position of the support plates they must be moved outwardly to accommodate the roll, whereupon the bosses 79 move longitudinally in the slot portion 87, stopping when they encounter the opposite end 89 of the slot portion 87. Accordingly, the ends 89 of the slot portions 87 at each end of the cutter bar limit outward movement of the support plates to an amount sufficient to permit mounting of the roll of rolled toweling material. It should be noted that when the spaced support plates 27 and 28 are spread to this extent, the upper edge 29 of each support plate has engaged the bottom surface of the tongue flange 22, resiliently bending the tongue upwardly and thus imposing a resilient biasing force on the support plate about its respective pivot pin 39. It should be noted that engagement of the upper edge 29 of each support plate with the associated tongue flange 22 is offset from the pivotal axis of the support plate, thus providing a lever arm or moment through which the resilient biasing force is exerted. It should also be noted that when the bosses 79 are in slots 86, the ends of the cylindrical bosses 84 lie flush with the bottom of the recesses 76 and disengaged from the complimentary bores 76'.

Mounted on the top surface 91 of the cutter bar body is a cutter bar plate 92, secured to the cutter bar body by rivets 93, and having a serrated cutting edge 94 along one edge portion 96 of the plate 92, which projects beyond the associated edge 83 of the underlying cutter bar body 81. As seen in FIGS. 5 and 6, the edge portion 96 of the cutter bar plate 92 is curved to conform more or less with the curvature of the edge 83, and then beyond the edge 83 curves in a direction away from the edge 83 to terminate in the serrated cutting edge 94.

The cutter bar plate 92 overlies a second plate 97, the leading edge of which includes sharp points 98 that project through openings 99 formed at spaced intervals along the length of the plate 92 in the curved portion 96 thereof. The points 98 project to a height greater than the serrated cutting edge 94. Thus, as seen in FIG. 3, when the strip 101 of sheet material is pulled tautly over the cutter bar 81 and downwardly against the serrated cutting edge 94, the sharp points 98 penetrate the strip of sheet material and prevent the strip of sheet material from retreating off the cutter bar, thus leaving it attached to the cutter bar by the sharp points ready to be grasped and pulled again over the serrated cutting edge to cut another portion of the strip from the roll. It should be understood that when the strip is grasped again to cut another portion, the strip end is lifted so as to clear the end of the material from the sharp points, until the strip is then again lowered and pressed against the sharp serrated cutting edge, whereupon the material is again hooked on the sharp points 98. It will of course be apparent that while I have utilized a separate bar on which to form the sharp points 98, these may be formed from the body of plate 92 and bent into their upwardly projecting attitude, with or without formation of the apertures 99.

As viewed in FIG. 3, it will be seen that the cutter bar 81 is positioned to receive the extended strip sheet material that is rolled on the rear roll, i.e., the one farthest from the eye as viewed in FIG. 1, and on the right as viewed in FIG. 3. This roll is of course mounted on support assembly 43. To provide means for cutting the strip of material 102 emanating from the roll of sheet material mounted on the support assembly 44, i.e., the one nearest the eye when viewed from the front as in FIG. 1, and on the left as viewed in FIG. 3, there is provided a second cutter bar designated generally by the numeral 103 and illustrated in FIGS. 1–3, 13–14 and 17–18.

As there shown, the second cutter bar 103 includes an elongated main body member 104, formed with flanges 106 at opposite ends, each flange having a bore 107 therethrough by which the cutter bar 103 is pivotally and detachably secured to the end flanges 12 and 13 of the base member 2. At one end, the bored flange 106 slips over a complimentary stub shaft 105 or boss molded integrally with one of the flanges 12 or 13, while at the opposite end, the corresponding flange 106 is secured to the associated flange 12 or 13 by a removable stud 106' having a knurled knob and adapted to be removably inserted through the associate bore 107 in the flange 106 and into a snug bore 108 formed in the associated flange 12 or 13. A gusset 109 is provided at each end adjacent each flange and functions as a stop and support to limit pivotal downward movement of the cutter bar 103. In its lowermost position as illustrated in FIG. 14, the cutter bar is in position of use and engages notches 103' formed in edges 32 of each support plate. In this position of the cutter bar, the strip 102 of sheet material is drawn over the cutter bar body and over the cutter bar plate 110 secured to the upper surface thereof. The cutter bar plate 110 is of the same type as previously discussed with respect to the cutter bar 81, including a sharp serrated edge 111, and sharp points 112 projecting away from the serrated plate 110, by which the strip material is again grasped and retained in readily accessible position.

Figure 13:
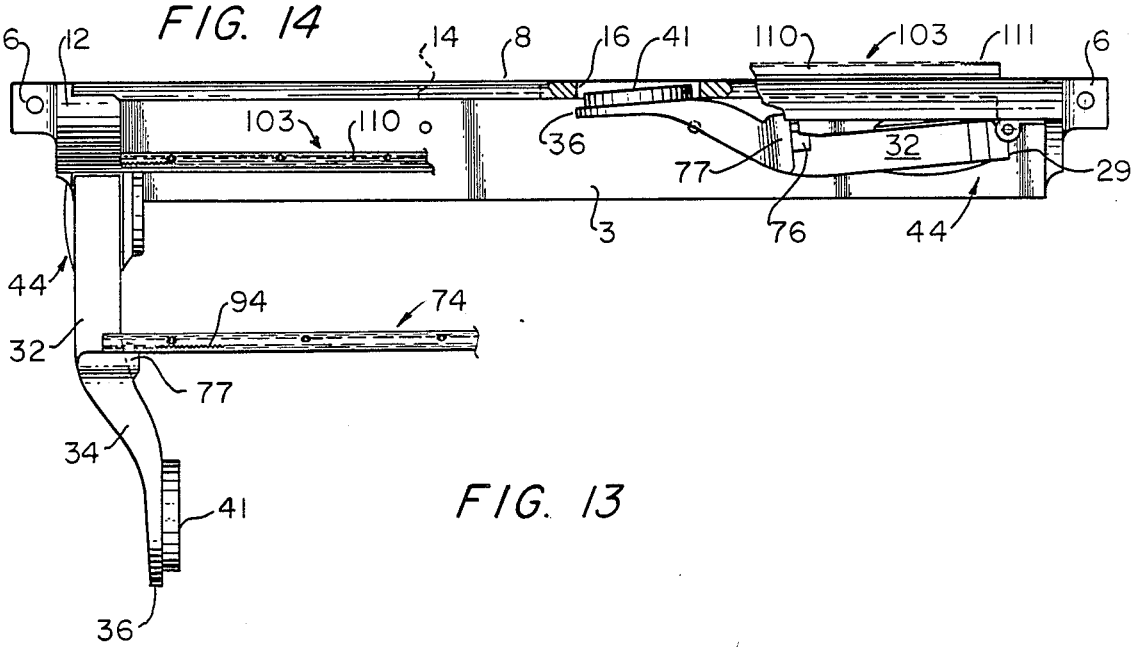
FIG. 13 is a front elevational view of the rolled sheet material dispensing device showing one of the roll support members collapsed and the other extended.

To facilitate mounting of the roll of sheet material on the forward roll support assembly 44, the cutter bar 103 may be pivoted upwardly into the position illustrated to the right in FIG. 13. This causes the cutter bar to be swung upwardly out of the way of the roll intended to be mounted, giving free access to the roll support assemblies, which have been retracted, as previously explained. It will thus be seen that three rolls of rolled sheet material may be conveniently mounted on the device, and empty rolls just as easily removed and new rolls mounted in their place. Additionally, such mounting and demounting of the separate rolls may be accomplished without disturbing the other rolls of rolled sheet material mounted in the device.

As a further advantage of my device, it should be noted that for packaging and shipping, the cutter bar 81 is removable so that, upon upward pivotal movement of the second cutter bar 103 to the position illustrated in FIG. 13 to disengage the second or upper cutter bar from the notches 103', the two support plates may be pivoted inwardly toward each other so as to lie in the position of the support plate 28 in FIG. 13, with the bosses 41 of the support plates extending into and being received by the apertures 14 and 16 formed in the base member 2. In this condition of the device, it occupies minimum space, thus reducing the cost of packaging materials and of volumne, and permitting more of the devices to be shipped in any one shipment within a limited amount of space. Additionally, if it is desired to also remove the second cutter bar before the device is packaged, this may be easily done by removing the removable stud by pulling gently on the knurled knob, thus releasing the cutter bar 103 from its pivotal attachment to the associated flanges 12 and 13.

Having thus described my invention, what is believed to be new and novel and sought to be protected by letters patent of the United States is as follows:

I claim:

1. A rolled sheet material dispensing device, comprising:

(a) a main body portion including a generally rectangular member having a front edge, a rear edge and left and right end edges and adapted to be detachably secured to a mounting structure;

(b) a pair of support platespivotally mounted on the main body portion adjacent opposite ends thereof and extending substantially parallel to said main body portion when in collapsed position and substantially perpendicular thereto when in extended position;

(c) a plurality of support bosses on each of said support plates, corresponding ones of said bosses on opposed support plates constituting a pair adapted to engage and rotatably support a roll of rolled sheet material; and (d) at least two cutter bars supported on said main body portion and bridging the space between said support plates in cooperative association with selected pairs of said support bosses, whereby strip sheet material rotatably mounted on said bosses may be drawn over and against said cutter bars to effect severing of a length thereof from said roll of said material.

2. The combination according to claim 1, in which one of said cutter bars is mounted on said main body portion and the other of said cutter bars is mounted on said support plates.

3. The combination according to claim 1, in which said pairs of bosses are resiliently biased in a direction to diminish the space therebetween, whereby when a roll of sheet material is disposed on pairs of said bosses the roll of sheet material is resiliently clamped on said bosses between said support plates.

4. The combination according to claim 1, in which one of said cutter bars is removably supported on said main body portion.

5. The combination according to claim 2, in which said cutter bar mounted on said support plates is removably supported thereon, and means on said cutter bar cooperatively associated with said support plates to limit movement of the support plates in a spreading direction.

6. The combination according to claim 1, in which means are associated with each cutter bar operative to grasp the material being cut to retain the unsevered portion of the strip material anchored in association with the cutter bar whereby the end of the material is readily accessible to effect another severing operation.

7. The combination according to claim 1, in which said plurality of support bosses includes two pairs of opposing support assemblies, each assembly including a boss portion and a knob portion adapted to be grasped between two fingers, and a coil spring interposed between said boss portion and said knob portion whereby said boss portion may be retracted against the resilient pressure of the spring to increase the distance between two corresponding support assemblies.

8. The combination according to claim 1, in which a resilient tongue is provided at each end of the main body portion, and said support plates are mounted pivotally mounted on said main body portion in association with said tongues, whereby movement of said support plates outwardly in a spreading direction effects resilient displacement of said tongues to thereby impose an inwardly biasing force on said support plates.

9. The combination according to claim 1, in which means are provided on one of said cutter bars and said support plates cooperating to limit inward collapse of said support plates in the absence of a roll of sheet material to hold them apart and to limit outward spreading of the support plates when the support plates are spread to mount a roll of rolled sheet material thereon.

10. The combination according to claim 1, in which said plurality of support bosses includes two pairs of opposed bosses axially slidable on said support plates.

11. The combination according to claim 1, in which said plurality of support bosses includes two pairs of opposed bosses rotatably mounted on said support plates.

12. The combination according to claim 1, in which said plurality of support bosses includes two pairs of opposed bosses that are both rotatably and axially slidable on said support plates.

* * * * *